United States Patent [19]

Shinoda

[11] Patent Number: 4,495,916

[45] Date of Patent: Jan. 29, 1985

[54] FUEL INJECTION PUMP CONTROL SYSTEM IN DIESEL ENGINE

[75] Inventor: Kazuo Shinoda, Aichi, Japan

[73] Assignee: Toyota Jidosha Kabushiki Kaisha, Japan

[21] Appl. No.: 429,432

[22] Filed: Sep. 30, 1982

[30] Foreign Application Priority Data

Dec. 14, 1981 [JP] Japan ..... 56-201142

[51] Int. Cl.[3] ..... F02D 1/06; F02D 1/02

[52] U.S. Cl. ..... 123/387; 123/502; 123/357; 123/449

[58] Field of Search ..... 123/502, 357, 387, 449, 123/385, 386, 358, 359; 137/831

[56] References Cited

U.S. PATENT DOCUMENTS

| | | | |
|---|---|---|---|
| 3,266,512 | 8/1966 | Turick | 137/831 |
| 3,521,653 | 7/1970 | Becker | 137/831 |
| 3,635,603 | 1/1972 | Eheim | 123/387 |
| 4,278,058 | 7/1981 | Berner | 123/387 |
| 4,368,709 | 1/1983 | Yasuhara | 123/502 |

FOREIGN PATENT DOCUMENTS

| | | | |
|---|---|---|---|
| 3037730 | 5/1982 | Fed. Rep. of Germany | 123/502 |
| 10830 | 1/1979 | Japan | 123/386 |
| 92329 | 7/1981 | Japan | 123/502 |

*Primary Examiner*—Charles J. Myhre
*Assistant Examiner*—Carl Stuart Miller
*Attorney, Agent, or Firm*—Finnegan, Henderson, Farabow, Garrett & Dunner

[57] ABSTRACT

A piston mechanism is driven in accordance with fuel pressure from a feed pump by a control valve controlled in response to a control signal from a control device. A spill ring of a fuel injection pump is moved by the piston mechanism, and torque characteristics of an engine are set at a desired value without receiving an influence of fuel pressure.

11 Claims, 5 Drawing Figures

FUEL INJECTION PUMP CONTROL SYSTEM IN DIESEL ENGINE

BACKGROUND OF THE INVENTION

1. Field of the Invention

This invention relates to fuel injection pump control system in diesel engines, and more particularly to a fuel injection pump control system in a diesel engine, most suitable for electronically controlling a fuel injection pump in a diesel engine.

2. Description of the Prior Art

In a conventional fuel injection pump used in a diesel engine the spill position for controlling fuel flow rate by a plunger is directly, mechanically controlled. If the spill position is directly controlled, the torque of the engine has substantially flat characteristics against a rotational speed as shown in FIG. 1. In a vehicle having mounted thereon such an engine as described above, rise of the torque of the engine is bad and the driving feeling is worse than in the gasoline motor vehicle.

In another known fuel injection pump movement of the accelerator pedal of a motor vehicle is imparted through a governor to operate the spill position. The torque characteristics of the fuel injection pump having the above-described construction are shown in FIG. 2. The torque characteristics against the rotational speed are very steep, and hence, a high torque can be obtained by a slight depression of the accelerator pedal. However, there is a possibility of occurrence of an abrupt start, so that it cannot be said that the above-described characteristics should necessarily be suitable for use in an engine to be mounted on a passenger vehicle.

Particularly, it is desired that the torque characteristics in a diesel engine are as close as possible to those in a gasoline engine.

SUMMARY OF THE INVENTION

The present invention has as its object the provision of a fuel injection pump control system in a diesel engine, in which the torque characteristics are selectable against a rotational speed of an engine.

The present invention contemplates that a piston mechanism is provided for operating a spill position commensurate to fuel pressure in a feed pump, and the piston mechanism is driven by a control valve to be controlled by an electronic circuit.

DETAILED DESCRIPTION OF THE INVENTION

Figure 1:
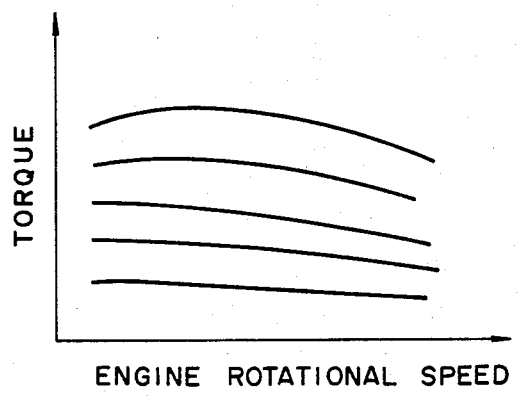
FIG. 1 is a diagram showing a torque characteristics in a diesel engine, which is publicly known.
Figure 2:
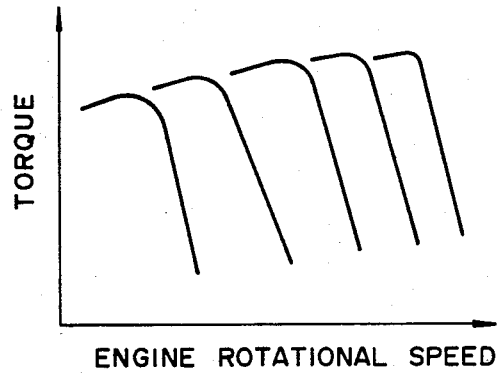
FIG. 2 is a diagram showing another torque characteristics in a diesel engine.
Figure 3:
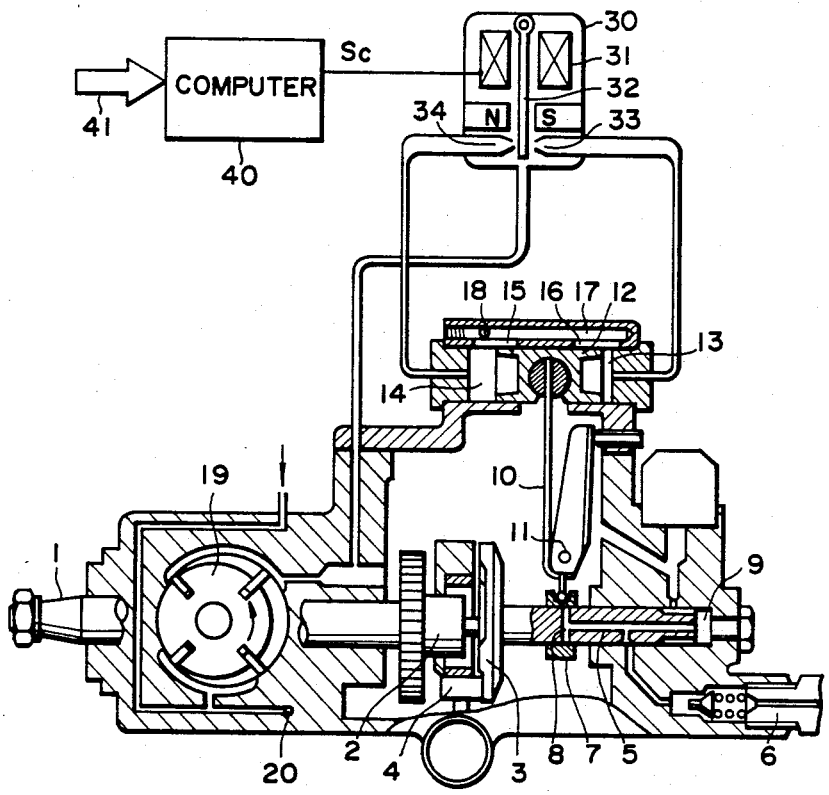
FIG. 3 is a sectional view showing an embodiment of the present invention.

In FIG. 3, a pump section and a roller and plunger section are similar in function to the conventional ones, however, a spill position control mechanism is different in function from the conventional one. A shaft 1 driven by an engine in turn drives a cam 3 through a coupling

2. The cam 3 is provided at its surface opposed to the coupling 2 with corners projecting toward the coupling 2. Each time one of these corners abuts against a stationary roller 4, the corner is pushed to the right. A plunger 5 is connected to the cam 3, whereby a fuel flow rate discharged into a union 6 is controlled in accordance with a connected state between a passage formed in the plunger 5 and a passage formed in a side wall. Further, a spill ring 7 is coupled onto the plunger 5 on the side of the cam 3, and an opening of a spill hole 8 (a hole for returning surplus fuel in a high pressure chamber 9) provided in the plunger 5 is controlled by this spill ring 7. In a state where the spill hole 8 is opened, fuel discharge to the engine can be retarded or possibly prevented entirely. Conversely, when spill hole 8 is closed, all fuel flows to the engine. Namely, in the state where the spill ring 7 has been moved to the right in the drawing, the spill hole 8 is blocked at all positions for the injection process, whereby the fuel injection flow rate becomes highest. Furthermore, in a state where the spill ring 7 has been moved to the left in the drawing, the spill hole 8 is opened in the initial stage of the injection process, whereby the fuel injection flow rate becomes lowest. Movement of the spill ring 7 in the lateral direction makes it possible to control the fuel injection flow rate.

The spill ring 7 is driven by a control lever 10 linkingly connected to one end of the spill ring 7. The control lever 10 is engaged with a fulcrum 11 and one end of the control lever 10 on the longer side is rotatably engaged with a piston 12. The piston 12 is combined with pressure chambers 13 and 14, slits 15 and 16, a bypass passage 17 and a port 18 to constitute a spill position adjusting mechanism.

Part of fuel from a feed pump 19 is fed to the pressure chambers 13 and 14 through a control valve 30. The control valve 30 is adapted to divide fuel from the feed pump 19 to be sent to the pressure chambers 13 and 14. The bypass passage 17 is communicated with the slits 15 and 16 formed on the top surfaces of the pressure chambers 13 and 14. Fuel from the pressure chambers flows into this bypass passage 17, part of which fuel flows out into a port 20 through a port 18, and further, is returned to the suction side of the feed pump 19. Opening areas of the slits 15 and 16 are varied commensurate to a movement value of the piston 12, so that a suitable braking effect for controlling a discharge value of fuel can be given to the piston 12.

The control valve 30 is constituted by a coil 31 driven by a computer (for example, a microcomputer) in response to a signal of a predetermined duty ratio, an armature 32 whose forward end portion oscillates as the coil 31 is energized, and flapper valves 33 and 34, openings of which are opposed to the forward end portion of the armature 32. A computer 40 produces a command signal Sc to be fed to the control valve 30 in response to input signals 41 of an engine rotational speed, cooling water temperature, accelerator opening and the like.

Figure 4:
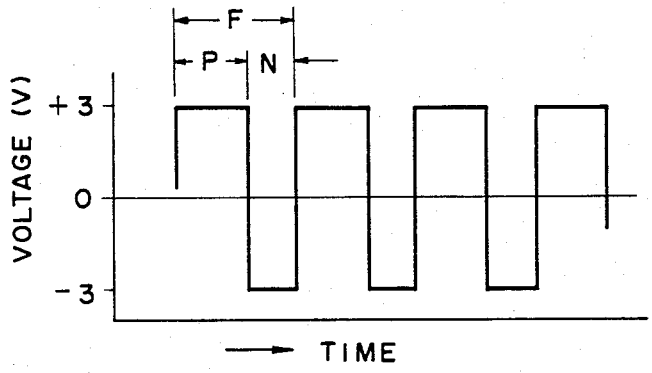
FIG. 4 is a wave form diagram showing an example of a command signal Sc according to the present invention.

FIG. 4 is a wave form diagram showing an example of the command signal Sc. In the drawing, designated at F is a cycle of Sc having a rectangular wave form and being a constant time period, and P a time period for a section between positive polarities. A ratio between the cycle F and the time period P, i.e., P/F indicates a duty ratio. This duty ratio is varied, whereby the flapper valve 33 or 34 is actuated, and finally, the spill ring 7 is operated to perform fuel injection control.

Figure 5:
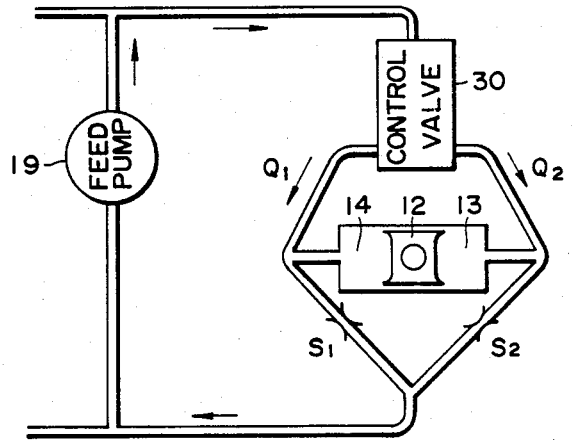
FIG. 5 is a flow chart of control in explanation of the principle of operation of the present invention.

FIG. 5 is a flow chart of control in explanation of the principle of operation of the present invention. Reference numerals in the drawing coincide with the members shown in FIG. 3.

Fuel for control sent out of the feed pump 19 is divided into $Q_1$ and $Q_2$ by means of the control valve 30. The armature 32 of the control valve 30 is driven by positive and negative polarities in response to the command signal shown in FIG. 4, whereby the flapper valves 33 and 34 repeat alternate opening actions. The flow rate of fuel sent out via the flapper valves 33 and 34 is determined by a rate of the time periods of the valve openings, i.e., the duty ratio. In consequence, the relations between the flow rates $Q_1$ and $Q_2$ may be represented by the following equation.

$$P/F=Q_1/(Q_1+Q_2) \quad (1)$$

On the other hand, in a state where the piston 12 is stationary, the relations between opening areas $S_1$ and $S_2$ of the slits 15 and 16 may be represented by the following equation.

$$Q_1/Q_2=S_1/S_2 \quad (2)$$

The duty ratio obtained from the equations (1) and (2) may be represented by the following equation.

$$P/F=Q_1/(Q_1+Q_2)=S_1/(S_1+S_2) \quad (3)$$

Furthermore, changes in the opening areas $S_1$ and $S_2$ are determined by a displacement of the piston 12, whereby the relations therebetween may be represented by the following equation.

$$P/F=S_1/(S_1+S_2)\propto \text{PISTON STROKE} \quad (4)$$

Namely, the stroke of the piston 12 is principally decided by the duty ratio of the command signal Sc, but, not influenced by the pressure of the feed pump 19 at all. The pressure of the feed pump 19 is greatly varied depending on the variability in production, wear of various portions during the process of service, a fuel flow rate on the side of high pressure, a pump rotational speed and the like. However, according to the present invention, the duty ratio can be determined depending only on the command signal, so that the influence of the changes in pressure can be eliminated. When the command signal Sc being outputted in the stabilized state of the piston 12 is varied, the ratio between $Q_1$ and $Q_2$ is varied accordingly, whereby the pressures in the pressure chambers 13 and 14 are changed to continue to move the piston 12 until it reaches the stabilized state. Upon completion of movement of the piston 12, the pressures in the pressure chambers 13 and 14 are balanced with each other at the position where the condition $Q_1/Q_2=S_1/S_2$ is satisfied again, whereby the piston 12 is stopped.

As has been described hereinabove, the command signal Sc is calculated by the computer 40, and an accurate piston stroke is obtained in response to this command signal Sc. Hence, if the method of calculation by the computer is designed to the optimum, then the injection flow rate characteristics against the engine rotational speed, i.e., the torque characteristics may be desirably designed. Furthermore, the fuel injection flow rate can be controlled to the optimum depending on the operating conditions of the engine in response to the input signals of the engine cooling water temperature, atmospheric pressure and the like.

In addition to the construction of the control valve shown in FIG. 3, such a construction may be adopted that the fuel passage from the feed pump 19 is divided into two parts which are communicated with the pressure chambers 13 and 14 via two solenoid valves, respectively. However, in this case, it is necessary to apply to the two solenoid valves, respectively, a rectangular wave signal having both polarities and being similar to a signal wave form shown in FIG. 4 and another rectangular wave signal having both polarities and being opposite in phase to a signal wave form shown in FIG. 4.

Further, the slits 15 and 16 shown in FIG. 3 may be replaced by two flow control valves each being variable in area in accordance with the movement of the piston 12 and which are actuated in operational association with the piston 12, respectively.

What is claimed is:

1. A fuel injection pump control system in a diesel engine wherein injection timing of fuel from an engine-driven feed pump is controlled by a plunger rotatably and axially movable in synchronism with engine rotation and fuel injection flow rate is controlled by the position of a spill ring movably associated with said plunger, said system comprising:

an electronic control section providing an output command signal in accordance with engine operating conditions;

control valve means selectively dividing a portion of fuel from said feed pump into two parts in response to a command signal; and a spill ring adjusting means for positioning said spill ring independent of feed pump pressure including:

a cylinder, a piston reciprocally received in said cylinder, respective ones of said two fuel parts being separately applied to said cylinder at opposite ends of said piston, said piston being linkingly connected to the spill ring, and a pair of flow discharge means operatively connected to said cylinder for continually releasing said two fuel parts from said cylinder, the flow rate through each individual flow discharge means being determined by the position of said piston in said cylinder so that an increase in the flow rate of one of said two fuel parts provides an increase in the flow rate through a corresponding one of the flow discharge means and a decrease in the flow rate through the other flow discharge means.

2. A fuel injection pump control system in a diesel engine as set forth in claim 1, wherein said control valve means comprises:

a pair of flapper valves for feeding fuel; and an armature for stopping fuel feed from said flapper valves when said armature abuts against an opening of one of said flapper valves.

3. A fuel injection pump control system in a diesel engine as set forth in claim 1, wherein said control valve means comprises a pair of solenoid valves being alternately driven by said command signal.

4. A fuel injection pump control system in a diesel engine as set forth in claim 1 wherein the command signal outputted from said electronic control section is one, in which a duty ratio of a rectangular wave signal having a predetermined cycle is varied in accordance with a fuel injection time.

5. A fuel injection pump control system in a diesel engine as set forth in claim 1, wherein each of said pair of flow discharge means includes a flow rate control valve having an opening area thereof varying in accordance with the movement of said piston.

6. The fuel injection pump control system in a diesel engine as set forth in claim 1 wherein both of said flow discharge means discharge to a common conduit.

7. The fuel injection pump control system in a diesel engine as set forth in claim 1 wherein said flow discharge means are also for braking said piston, whereby hunting movement of said piston is suppressed.

8. The fuel injection pump control system in a diesel engine as set forth in claim 1 wherein the position of said piston in said cylinder determines the flow area through each of said discharge means.

9. The fuel injection pump control system in a diesel engine as set forth in claim 1 wherein each of said discharge means includes an aperture in said cylinder positioned for being at least partially obstructable by said piston, said piston position determining the effective flow areas through said apertures.

10. The fuel injection pump control system in a diesel engine as set forth in claim 9 wherein said apertures both discharge to a bypass passage.

11. The fuel injection pump control system in a diesel engine as set forth in claim 9 wherein said apertures are slits positioned in the sidewall of said cylinder.

* * * * *